US007695305B1

(12) United States Patent
Ray et al.

(10) Patent No.: US 7,695,305 B1
(45) Date of Patent: Apr. 13, 2010

(54) CONNECTOR RETAINER

(75) Inventors: Brian Ray, Livermore, CA (US); Adolpho Gonzalez, Fresno, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 0 days.

(21) Appl. No.: 12/021,834

(22) Filed: Jan. 29, 2008

(51) Int. Cl.
*H01R 13/627* (2006.01)

(52) U.S. Cl. ..... 439/359; 439/372; 439/484

(58) Field of Classification Search ..... 439/373, 439/359, 345, 372, 484
See application file for complete search history.

(56) References Cited

U.S. PATENT DOCUMENTS 1,143,536 A * 6/1915 Goodridge ..... 439/361
2,266,560 A * 12/1941 Mansfield ..... 439/368
2,399,644 A * 5/1946 Lachance ..... 439/362
2,569,037 A * 9/1951 Dalton ..... 439/368
3,811,104 A * 5/1974 Caldwell ..... 439/135
6,520,792 B2 * 2/2003 Chen-Chiang et al. ..... 439/373
6,767,237 B1 * 7/2004 Shih ..... 439/371
7,513,791 B1 * 4/2009 McLeod ..... 439/373

* cited by examiner

*Primary Examiner*—Edwin A. Leon
*Assistant Examiner*—Vanessa Girardi
(74) *Attorney, Agent, or Firm*—Harrity & Harrity, LLP

(57) ABSTRACT

A system retains a connector connected to a device. The system includes a bail lock capable of connecting to the device, and a retainer capable of connecting to the bail lock. Rotation of the retainer moves the bail lock along the retainer until the connector securely attaches to the device.

24 Claims, 8 Drawing Sheets

CONNECTOR RETAINER

BACKGROUND

Devices (e.g., computing devices, communication devices, etc.) require various connectors (e.g., communication cable connectors, power cords, etc.) to properly function. However, such connectors may become disconnected from devices due to vibrations, earthquakes, accidental removal, etc. This may cause the devices to malfunction. For example, a communication cable or power cord may disconnect from a network device, which may cause the network device to cease transmitting and/or receiving network traffic. This may result in partial or complete failure of a network containing the network device.

Typically, a connector attaches to a device via a port configured to receive a particular connector. Additional brackets or clips may be utilized to retain the connector in the device port. However, such additional brackets or clips may break, and may be expensive and difficult to manipulate.

SUMMARY

According to one aspect, a system for retaining a connector connected to a device, may include a bail lock that includes a foot portion capable of connecting to the device, an elongate portion that includes a first distal end connected to the foot portion, and a connecting portion connected to a second distal end of the elongate portion. The system may also include a retainer that includes a threaded portion capable of engaging the connecting portion of the bail lock, and a head portion connected to the threaded portion. Rotation of the head portion may move the connecting portion of the bail lock along the threaded portion of the retainer to apply a retaining force between the retainer and the connector.

According to another aspect, a system for retaining a connector connected to a device may include a bail lock capable of connecting to the device, and a retainer capable of connecting to the bail lock. Rotation of the retainer may move the bail lock along the retainer until the connector securely attaches to the device.

According to yet another aspect, a method for retaining a connector connected to a device may include attaching the connector to the device, attaching a bail lock to the device adjacent to the connector, receiving a cord of the connector with a retainer, and connecting the bail lock to the retainer to securely attach the connector to the device.

BRIEF DESCRIPTION OF THE DRAWINGS

The accompanying drawings, which are incorporated in and constitute a part of this specification, illustrate one or more implementations described herein and, together with the description, explain these implementations. In the drawings.

DETAILED DESCRIPTION

The following detailed description refers to the accompanying drawings. The same reference numbers in different drawings may identify the same or similar elements. Also, the following detailed description does not limit the invention.

Systems and methods described herein may provide a connector retainer for ensuring attachment of a connector to a device. For example, in one implementation, the device may include a connector receiver configured to receive the connector, and the connector may be connected to the device via the connector receiver. The connector retainer may include a bail lock and a retainer. The bail lock may be connected to the device adjacent to the connector receiver. The retainer may be attached to the connector, and the bail lock may be connected to the retainer to securely attach the connector to the device. The connector retainer configuration described herein may prevent the connector from disconnecting from the device, and may be simple, easy to use, and inexpensive.

Exemplary System

Figure 1:
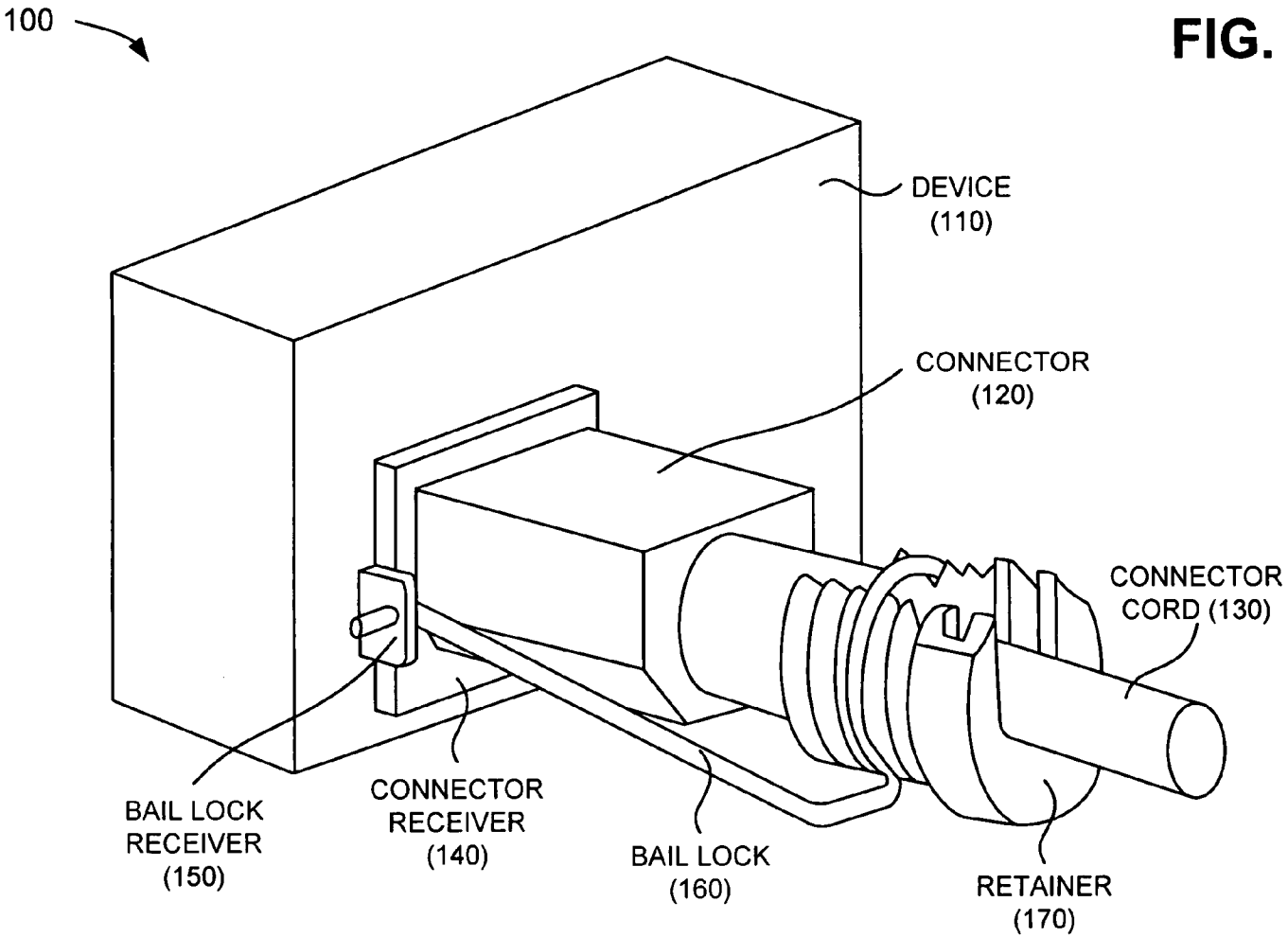
FIG. 1 is a diagram illustrating an isometric view of an exemplary system in which a connector retainer described herein may be implemented.

FIG. 1 is a diagram illustrating an isometric view of an exemplary system 100 in which a connector retainer described herein may be implemented. As illustrated, system 100 may include a device 110 (that includes a connector receiver 140 and a bail lock receiver 150), a connector 120, a connector cord 130, a bail lock 160, and/or a retainer 170.

Device 110 may include a network device (e.g., a gateway, a router, a switch, a firewall, a network interface card (NIC), a hub, a bridge, a proxy server, or some other type of device that processes and/or transfers data), a computation or communication device (e.g., a laptop, a personal computer, a work station, a server, etc.), a mobile communication device (e.g., e.g., a radiotelephone, a personal communications system (PCS) terminal that may combine a cellular radiotelephone with data processing, a facsimile, and data communications capabilities, a personal digital assistant (PDA), a telephone, a cellular telephone, etc.), and/or any other device capable of receiving a connector, such as connector 120. Although device 110 is shown in FIG. 1 as including connector receiver 140 and bail lock receiver 150, in other implementations, device 110 may include additional components (not shown) depending upon the function of device 110.

Connector 120 may include a power cord connector (e.g., a power supply connector, a plug, etc.), a communication cable connector (e.g., a Universal Serial Bus (USB) connector, an eight position, eight conductors (8P8C or "RJ45") connector, a nine-pin D-shell (DE-9) connector, an optical connector (e.g., a standard connector (SC), a ferrule connector (FC), a sub miniature A (SMA) connector, etc.), a telephone connector, etc.), etc.

Connector cord 130 may include a cord connected to connector 130. For example, connector cord 130 may include a power cord, a communication cable, etc., that may provide electricity, electrical signals, optical signals, etc. to device 110 via connector 120, depending upon the function of connector 120.

Connector receiver 140 may include a mechanism that is sized, shaped, and/or configured to receive connector 120. For example, if connector 120 is a power cord connector, connector receiver 140 may be sized and shaped to receive the size and shape of the power cord connector, and may include a ground, a positive connection, and a negative connection that may connect with a corresponding ground, positive connection, and negative connection provided in connector 120. Connector receiver 140 may attach connector 120 to device 110, and may enable connector 120 to communicate (e.g., electrically communicate, optically communicate, etc.) with device 110.

Bail lock receiver 150 may include a mechanism that is sized, shaped, and/or configured to receive a portion of bail lock 160, and to attach bail lock 160 to device 110. In one implementation, bail lock receiver 150 may attach to a portion of device 110 (e.g., adjacent to a side of connector receiver 140), and may include an opening for receiving and retaining a portion of bail lock 160. The opening of bail lock receiver 150 may act as a hinge about which bail lock 160 may rotate. Although not shown in FIG. 1, a corresponding bail lock receiver 150 may be provided adjacent to another side of connector receiver 140, and may receive and retain another portion of bail lock 160. Together, the openings in corresponding bail lock receivers 150, along with corresponding portions of bail lock 160 may provide a singular axis of rotation for bail lock 160.

Bail lock 160 may connect to device 110 and to retainer 170 and may provide a force on retainer 170 that may be conveyed to connector 120 to ensure that connector 120 remains connected to connector receiver 140. In one implementation, bail lock 160 or portions of bail lock 160 may resemble a handle to a pail or bucket. Bail lock 160 may be a variety of shapes and sizes depending upon the size and shape of connector 120. For example, in one implementation, bail lock 160 may be smaller in size if connector 120 is small (e.g., a telephone connector), and may be larger in size if connector 120 is large (e.g., a power cord connector). Bail lock 160 may be made from a variety of materials, such as a thermoplastic polymer (e.g., a polycarbonate resin, polyethylene, polypropylene, polyvinyl chloride, a fluoroplastic, etc.), a metal or metal alloy (e.g., stainless steel, copper, iron, nickel, zinc, brass, bronze, aluminum, etc.), a combination of the aforementioned materials, etc. Further details of bail lock 160 are provided below in connection with FIGS. 2 and 3A-3C.

Retainer 170 may receive connector cord 130, connect to bail lock 160, and apply a force on connector 120 to ensure that connector 120 remains connected to connector receiver 140 of device 110. In one implementation, retainer 170 may resemble a bolt that includes a cavity for receiving connector cord 130. Retainer may be a variety of shapes and sizes depending upon the size and shape of connector 120. For example, in one implementation, retainer 170 may be smaller in size if connector 120 is small (e.g., a telephone connector), and may be larger in size if connector 120 is large (e.g., a power cord connector). Retainer 170 may be made from a variety of materials, such as a thermoplastic polymer (e.g., a polycarbonate resin, polyethylene, polypropylene, polyvinyl chloride, a fluoroplastic, etc.), a metal or metal alloy (e.g., stainless steel, copper, iron, nickel, zinc, brass, bronze, aluminum, etc.), a combination of the aforementioned materials, etc. Further details of retainer 170 are provided below in connection with FIGS. 2 and 4A-4C.

Although FIG. 1 shows exemplary components of system 100, in other implementations, system 100 may contain fewer, different, or additional components than depicted in FIG. 1. In still other implementations, one or more components of system 100 may perform one or more of the functions described as performed by one or more other components of system 100.

Exemplary Connector Retainer Configuration

Figure 2:
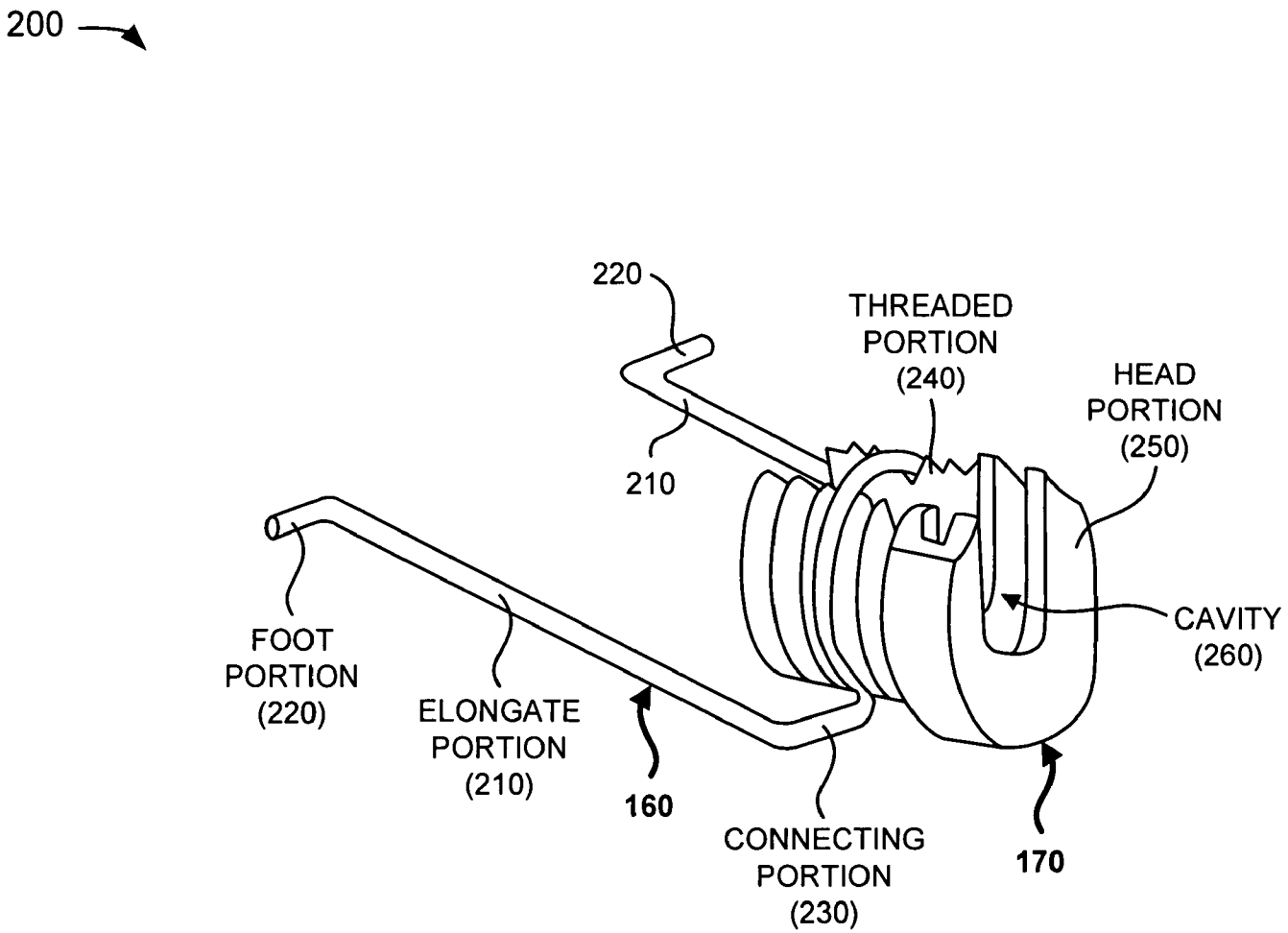
FIG. 2 is a diagram depicting an isometric view of a connector retainer of the exemplary system illustrated in FIG. 1.

FIG. 2 a diagram depicting an isometric view of a connector retainer 200. As illustrated, connector retainer 200 may include bail lock 160 and retainer 170. Bail lock 160 may include two elongate portions 210, foot portions 220 connected to first distal ends of elongate portions, and a connecting portion 230 connected to second distal ends of elongate portions 210. In one implementation, elongate portions 210, foot portions 220, and connecting portion 230 of bail lock 160 may be integrally formed together (e.g., via molding, extrusion, casting, etc.). In another implementation, elongate portions 210, foot portions 220, and connecting portion 230 of bail lock 160 may be connected together via a variety of connection mechanisms (e.g., via adhesives, glue, solder, and/or similar connection mechanisms). Portions 210-230 of bail lock 160 may or may not include uniform thicknesses. In one example, portions 210-230 of bail lock 160 may include a diameter in a range of about one (1) millimeter to about "1.5" millimeters. In another example, portions 210-230 of bail lock 160 may include a diameter substantially equal to about "1.18" millimeters.

Each of elongate portions 210 may include a substantially cylindrical-shaped body that includes a length that depends upon a length of connector 120. For example, in one implementation, each elongate portion 210 may be smaller in length if the length of connector 120 is small (e.g., a telephone connector), and may be larger in size if the length of connector 120 is large (e.g., a power cord connector). In one example, each elongate portion 210 may include a length in a range of about fifty (50) millimeters to about sixty (60) millimeters. In another example, each elongate portion 210 may include a length substantially equal to about "58.1" millimeters.

Each foot portion 220 may include a substantially cylindrical-shaped body that may be received in an opening provided in bail lock receiver 150 (FIG. 1). The opening of bail lock receiver 150 may be sized to accommodate foot portion 220, and may permit foot portion 220 to rotate. Each foot portion 220 may include a length that depends upon a thickness of bail lock receiver 150. In one example, each foot portion 220 may include a length in a range of about ten (10) millimeters to about fifteen (15) millimeters. In another example, each foot portion 220 may include a length substantially equal to about "13.47" millimeters.

Connecting portion 230 may include a substantially cylindrical-shaped body that is sized to connect to a portion of retainer 170. For example, in one implementation, connecting portion 230 may be sized to connect to a threaded portion 240 of retainer 170, as described below.

Further details of bail lock 160, foot portions 210, elongate portions 220, and connecting portion 230 are provided below in connection with FIGS. 3A-3C.

As further shown in FIG. 2, retainer 170 may include a threaded portion 240, a head portion 250, and a cavity 260 provided through sections of threaded portion 240 and head portion 250. In one implementation, threaded portion 240 and head portion 250 of retainer 170 may be integrally formed together (e.g., via molding, extrusion, casting, etc.). In another implementation, threaded portion 240 and head portion 250 of retainer 170 may be connected together via a variety of connection mechanisms (e.g., via adhesives, glue, solder, and/or similar connection mechanisms). Threaded portion 240 and head portion 250 of retainer 170 may or may not include uniform thicknesses.

Threaded portion 240 may include a substantially cylindrical-shaped body that includes one or more threads (e.g., right-handed threads or left-handed threads) capable of receiving connecting portion 230 of bail lock 160. In one implementation, connecting portion 230 and threaded portion 240 may be sized to engage each other. Threaded portion 240 may engage connector 120, and may be used to increase or decrease a force applied by retainer 170 on connector 120. For example, if the threads of threaded portion 240 are right-handed threads, turning retainer 170 clockwise may cause connecting portion 230 of bail lock 160 to move toward head portion 250 of retainer 170 and may cause retainer 170 to move toward connector 120 (FIG. 1). This may increase a force applied by retainer 170 on connector 120. Turning retainer 170 (with right-handed threads) counter-clockwise may cause connecting portion 230 of bail lock 160 to move away from head portion 250 of retainer 170 and may cause retainer 170 to move away from connector 120. This may decrease a force applied by retainer 170 on connector 120.

Head portion 250 may include a substantially cylindrical-shaped body that is sized so that it may be manipulated by a user of connector retainer 200. For example, in one implementation, head portion 250 may be sized so that a user may manipulate (e.g., rotate clockwise or counter-clockwise) retainer 170 with a thumb and finger. Although not shown in FIG. 2, in other implementations, head portion 250 may include one or more slots that form a drive design (e.g., a flathead, a Phillips head, a hex design, etc.). The drive design may be manipulated by a corresponding mechanism (e.g., a flathead screwdriver, a Phillips head screwdriver, an Allen wrench, etc.) so that a user may manipulate (e.g., rotate clockwise or counter-clockwise) retainer 170.

Cavity 260 may be formed throughout sections of threaded portion 240 and head portion 250, and may be sized to accommodate and receive connector cord 130 associated with connector 120 (FIG. 1). In one implementation, connector cord 130 may define a size of cavity 260, which, in turn, may define the sizes of threaded portion 240 and head portion 250. Connector cord 130 may engage walls formed by cavity 260, and may permit retainer 170 to rotate (e.g., clockwise or counter-clockwise).

Further details of retainer 170, threaded portion 240, head portion 250, and cavity 260 are provided below in connection with FIGS. 4A-4C.

Although FIG. 2 shows exemplary components of connector retainer 200, in other implementations, connector retainer 200 may contain fewer, different, or additional components than depicted in FIG. 2. In still other implementations, one or more components of connector retainer 200 may perform one or more of the functions described as performed by one or more other components of connector retainer 200.

Exemplary Bail Lock Configuration

Figure 3B:
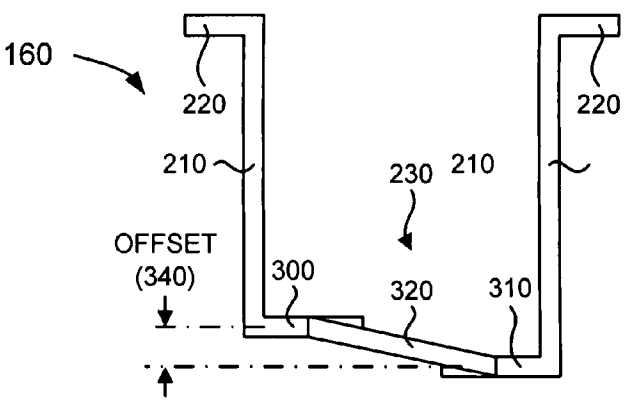
FIGS. 3A-3C are front, top, and side views, respectively, of a bail lock of the connector retainer depicted in FIG. 2.
Figure 3A:
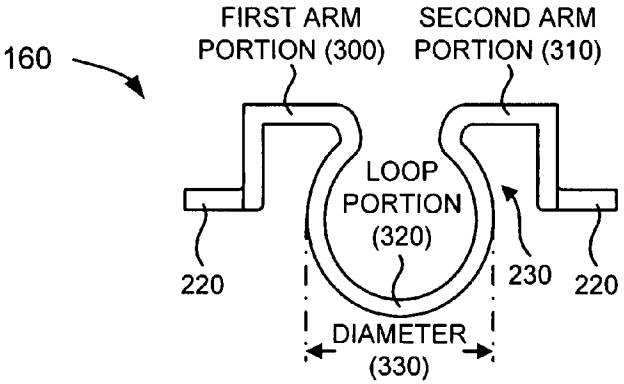
Figure 3C:
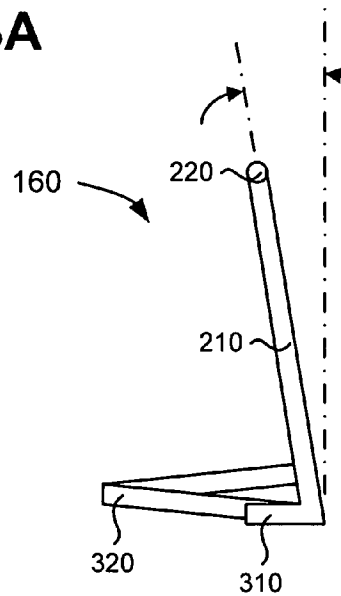

FIGS. 3A-3C are front, top, and side views, respectively, of bail lock 160. As illustrated in FIG. 3A, connecting portion 230 of bail lock 160 may include a first arm portion 300 and a second arm portion 310 interconnected by a loop portion 320.

As shown in FIG. 3B, first arm portion 300 may connect to one distal end of one elongate portion 210, and second arm portion 310 may connect to one distal end of another elongate portion 210. As further shown in FIG. 3A, first arm portion 300 and second arm portion 310 may extend upwards from elongate portions 210 (not shown), and may extend inwards (e.g., perpendicular to the directions of elongate portions 210) toward loop portion 320. For example, in one implementation, first arm portion 300 and second arm portion 310 may resemble elbows.

Loop portion 320 may connect to first arm portion 300 and to second arm portion 310, and may extend in a looped or circular manner downward from and between first arm portion 300 and second arm portion 310. In one implementation, as shown in FIG. 3A, loop portion 320 may include a diameter 330 sized to engage threaded portion 240 of retainer 170. In one example, diameter 330 may be in a range of about fifteen (15) millimeters to about twenty (20) millimeters. In another example, diameter 330 may be substantially equal to about "16.23" millimeters. In other implementations, loop portion 320 may include other shapes, such as oval, elliptical, etc.

As further shown in FIG. 3B, first arm portion 300 may be positioned relative to second arm portion 310 by an offset 340. Offset 340 may be provided so that loop portion 320 aligns with a helical configuration of threaded portion 240 of retainer 170. For example, the threads of threaded portion 240 may be provided in a helical configuration around retainer 170, and offset 340 may align loop portion 320 with the angled orientation of the threads corresponding to the helical configuration. Thus, a length of offset 340 may depend upon the configuration of threaded portion 240. In one example, offset 340 may include a length in a range of about two (2) millimeters to about "2.5" millimeters. In another example, offset 340 may include a length substantially equal to about "2.3" millimeters.

As shown in FIG. 3C, elongate portions 210 may be aligned at an angle 350 to a line substantially perpendicular to a plane of second arm portion 310. Angle 350 may be provided so that loop portion 320 aligns with threaded portion 240 of retainer 170, and may be sized based on the size of connector 120. In one example, angle 350 may include an angle in a range of about five (5) degrees to about ten (10) degrees. In another example, angle 350 may include an angle substantially equal to about "8.4" degrees. In other implementations, angle 350 may be omitted, and elongate portions 210 may be positioned substantially perpendicular to the plane of second arm portion 310.

Although FIGS. 3A-3C shows exemplary components of bail lock 160, in other implementations, bail lock 160 may contain fewer, different, or additional components than depicted in FIGS. 3A-3C. In still other implementations, one or more components of bail lock 160 may perform one or more of the functions described as being performed by one or more other components of bail lock 160.

Exemplary Retainer Configuration

Figure 4B:
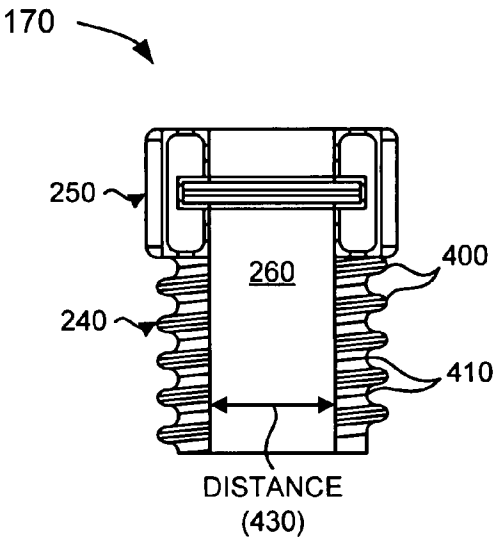
FIGS. 4A-4C are top, bottom, and side views, respectively, of a retainer of the connector retainer illustrated in FIG. 2.
Figure 4A:
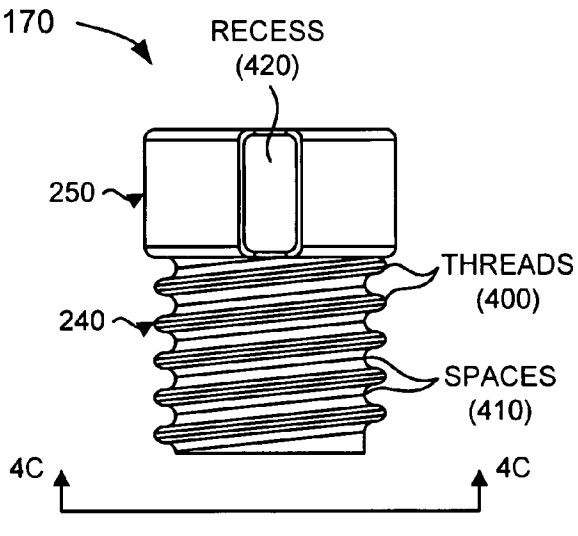
Figure 4C:
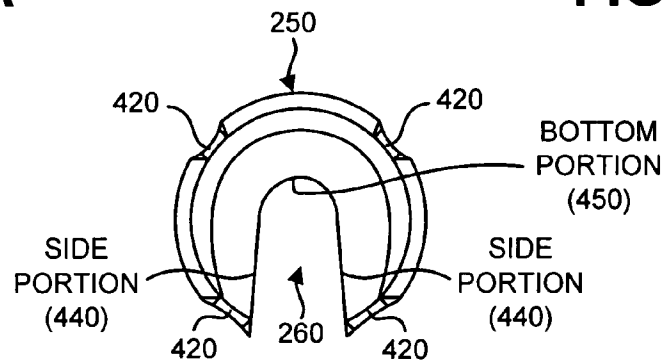

FIGS. 4A-4C are top, bottom, and side views, respectively, of retainer 170. FIG. 4C is a side view of retainer 170 taken along line 4C-4C of FIG. 4A. As illustrated in FIG. 4A, threaded portion 240 of retainer 170 may include threads 400 and spaces 410. One or more threads 400 may be provided in threaded portion 240, and one space 410 may be provided between adjacent threads 400. Threads 400 and spaces 410 may be configured similar to threads and spaces provided on a bolt or a screw. For example, threads 400 and spaces 410 may be provided in a helical configuration as either right-handed threads or left-handed threads.

In operation, loop portion 320 of bail lock 160 may be received in spaces 410, as shown in FIGS. 1 and 2, and may enable a user to manipulate a force applied by retainer 170 on connector 120. For example, if threads 400 are right-handed threads, turning retainer 170 clockwise may cause loop portion 320 of bail lock 160 to move toward head portion 250 of retainer 170 (e.g., via travel along spaces 410) and may cause retainer 170 to move toward connector 120 (FIG. 1). This may increase a force applied by retainer 170 on connector 120. Turning retainer 170 (with right-handed threads) counter-clockwise may cause loop portion 320 of bail lock 160 to move away from head portion 250 of retainer 170 (e.g., via spaces 410) and may cause retainer 170 to move away from connector 120. This may decrease a force applied by retainer 170 on connector 120. If threads 400 are left-handed threads, the inverse of the above example may occur.

As shown in FIGS. 4A and 4C, head portion 250 of retainer 170 may include one or more recesses 420. Recesses 420 may be formed on a peripheral surface of head portion 250, and may sized to enable a user to manipulate (e.g., rotate clockwise or counter-clockwise) retainer 170 with one or more digits (e.g., a thumb and a finger) of the user's hand. For example, a user may engage one recess 420 with a finger and another recess 420 with a thumb, and may rotate retainer 170 with forces applied by the thumb and the finger. Although not shown in FIGS. 4A-4C, in other implementations, head portion 250 may include one or more slots that form a drive design (e.g., a flathead, a Phillips head, a hex design, etc.). The drive design may be manipulated by a corresponding mechanism (e.g., a flathead screwdriver, a Phillips head screwdriver, an Allen wrench, etc.) so that a user may manipulate (e.g., rotate clockwise or counter-clockwise) retainer 170.

As shown in FIG. 4B, cavity 260 may include a distance 430 (e.g., a width) that may be sized to accommodate connector cord 130. Thus, distance 430 may include a variety of dimensions that may depend on the dimensions of connector cord 130. In one example, distance 430 may be in a range of about four (4) millimeters to about ten (10) millimeters. In another example, distance 430 may be substantially equal to about "4.25" millimeters. As further shown in FIG. 4B, cavity 260 may extend along a length of retainer 170 (i.e., through threaded portion 240 and head portion 250).

As further shown in FIG. 4C, cavity 260 may include two side portions 440 interconnected by a bottom portion 450. Side portions 440 and bottom portion 450 may be sized to accommodate connector cord 130. Side portions 440 may extend downwards into retainer 170 and towards bottom portion 450. In one implementation, side portions 440 may extend downward at a slight angle. Bottom portion 450 may include a variety of shapes (e.g., circular, elliptical, oval, square, etc.). In one example, bottom portion 450 may be semi-circular in shape.

Although FIG. 4 shows exemplary components of retainer 170, in other implementations, retainer 170 may contain fewer, different, or additional components than depicted in FIG. 4. In still other implementations, one or more components of retainer 170 may perform one or more of the functions described as being performed by one or more other components of retainer 170.

Exemplary Process

Figure 5:
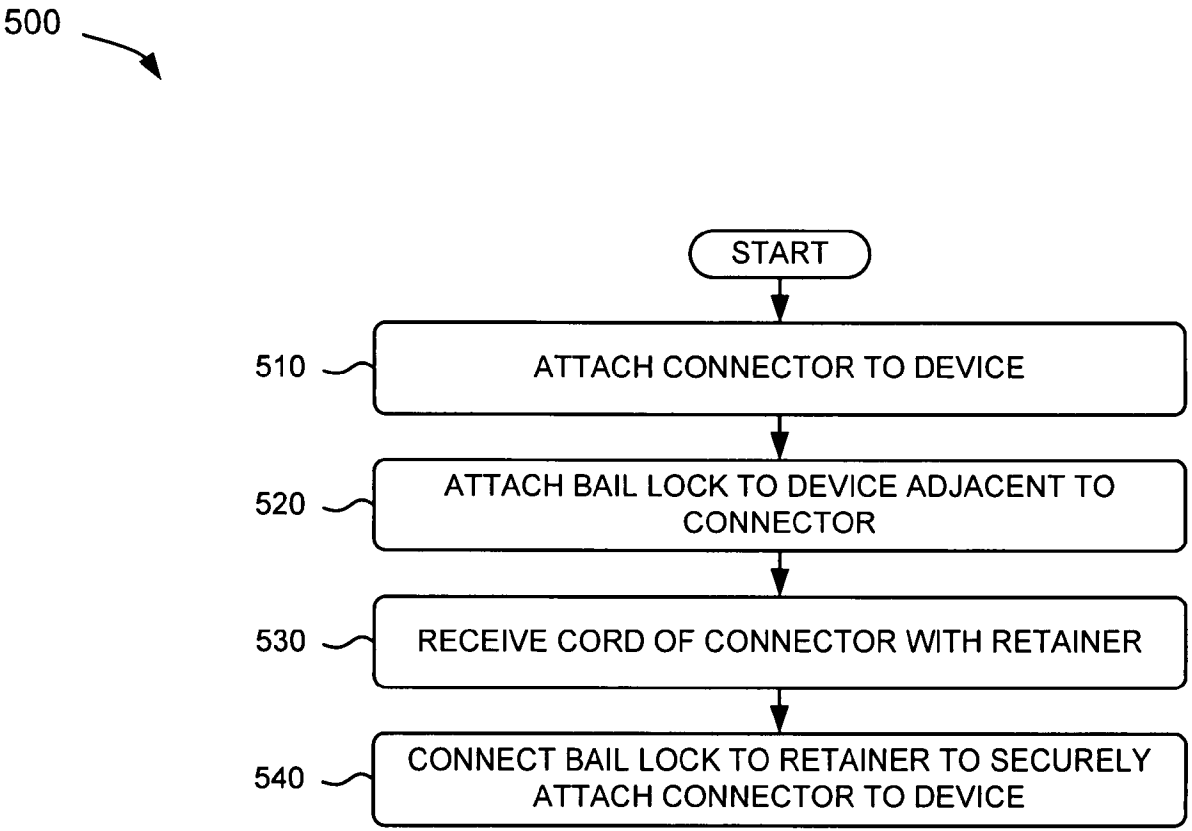
FIGS. 5-8 depict flowcharts of an exemplary process according to implementations described herein.

FIGS. 5-8 depict flowcharts of an exemplary process 500 according to implementations described herein. As shown in FIG. 5, process 500 may begin with attachment of a connector to a device (block 510), and attachment of a bail lock to the device adjacent to the connector (block 520). For example, in implementations described above in connection with FIG. 1, connector 120 may attach to connector receiver 140 of device 110, and connector receiver 140 may enable connector 120 to communicate (e.g., electrically communicate, optically communicate, etc.) with device 110. Bail lock receiver 150 of device 110 may receive a portion of bail lock 160, and attach bail lock 160 to device 110. In one example, bail lock receiver 150 may attach to a portion of device 110 (e.g., adjacent to a side of connector receiver 140), and may include an opening for receiving and retaining a portion of bail lock 160.

As further shown in FIG. 5, a cord of the connector may be received within a retainer (block 530), and the bail lock may be connected to the retainer to securely attach the connector to the device (block 540). For example, in implementations described above in connection with FIG. 1, retainer 170 may receive connector cord 130, and may include a cavity for receiving connector cord 130. Bail lock 160 may connect to retainer 170 and may provide a force on retainer 170 that may be conveyed to connector 120 to ensure that connector 120 remains connected to connector receiver 140 of device 110.

Figure 6:
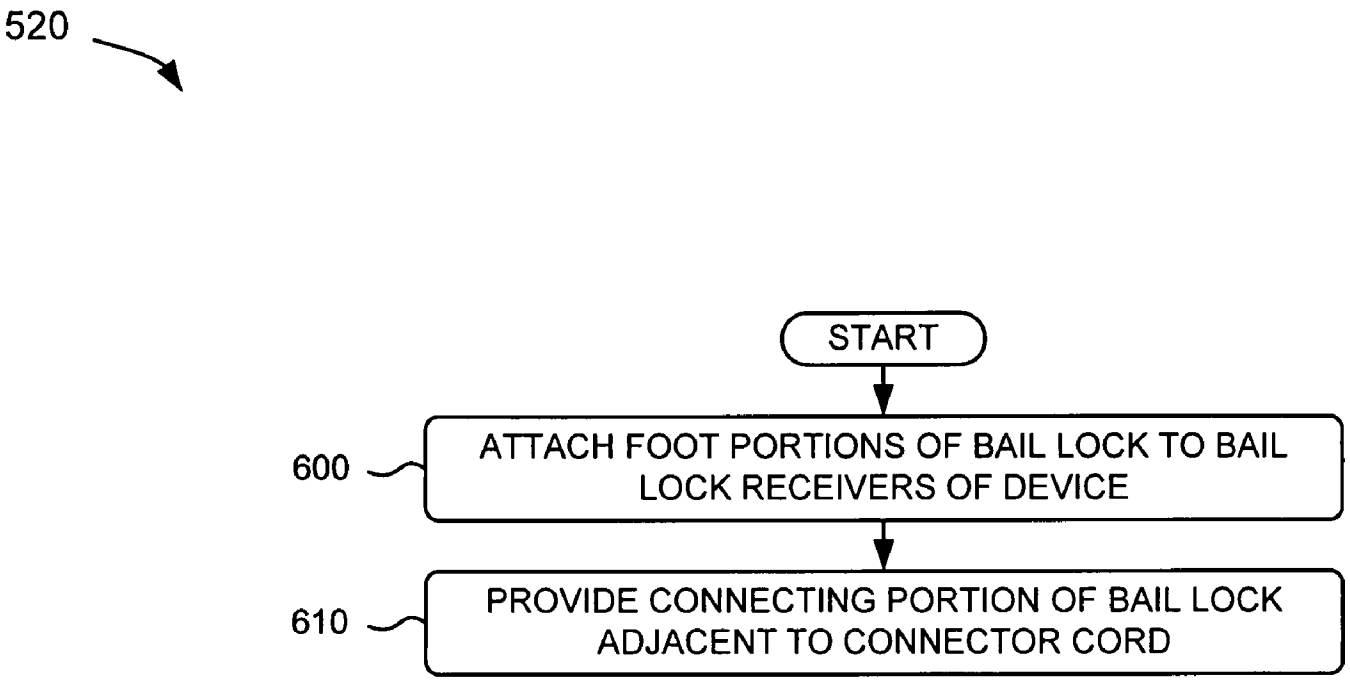

Process block 520 may include the process blocks depicted in FIG. 6. As illustrated in FIG. 6, process block 520 may include attaching foot portions of the bail lock to bail lock receivers provided on the device (block 600), and providing a connecting portion of the bail lock adjacent to the connector cord (block 610). For example, in implementations described above in connection with FIGS. 1 and 2, bail lock 160 may include foot portions 220. Bail lock receiver 150 may attach to a portion of device 110 (e.g., adjacent to a side of connector receiver 140), and may include an opening for receiving and retaining one foot portion 220 of bail lock 160. The opening of bail lock receiver 150 may be sized to accommodate foot portion 220, and may permit foot portion 220 to rotate. Connecting portion 230 of bail lock 160 may be provided adjacent to connector cord 130 and may be connected to threaded portion 240 of retainer 170.

Figure 7:
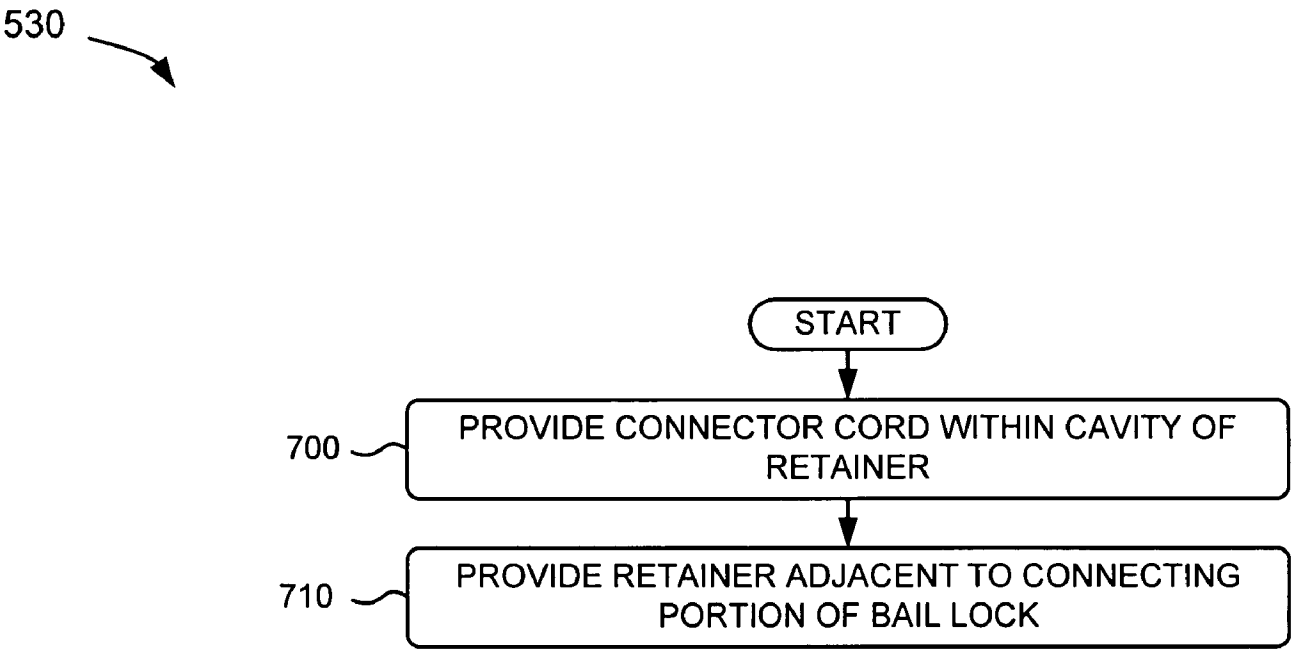

Process block 530 may include the process blocks depicted in FIG. 7. As illustrated in FIG. 7, process block 530 may include providing the connector cord within a cavity of the retainer (block 700), and providing the retainer adjacent to the connecting portion of the bail lock (block 710). For example, in implementations described above in connection with FIGS. 1 and 2, cavity 260 may be formed throughout sections of threaded portion 240 and head portion 250 of retainer 170, and may be sized to accommodate and receive connector cord 130 associated with connector 120. Connecting portion 230 of bail lock 160 may provided adjacent to threaded portion 240 of retainer 170 prior to attaching connecting portion 230 to threaded portion.

Figure 8:
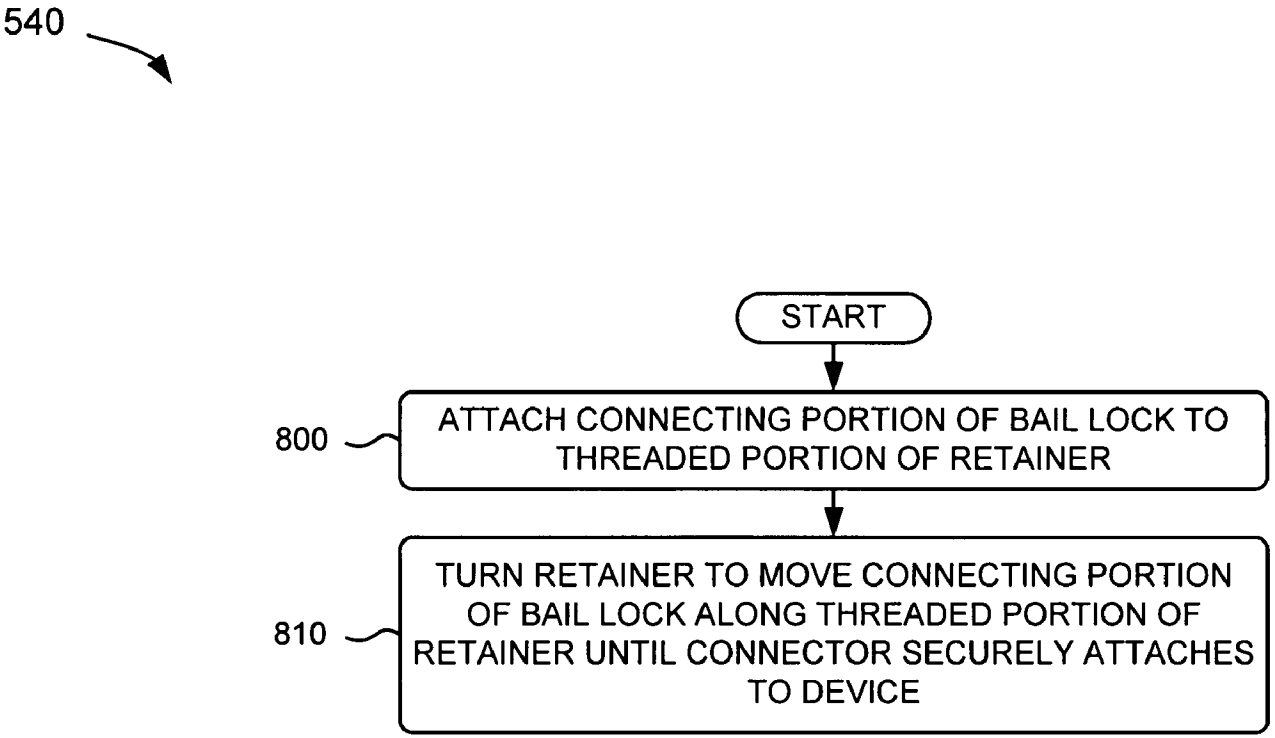

Process block 540 may include the process blocks depicted in FIG. 8. As illustrated in FIG. 8, process block 540 may include attaching the connecting portion of the bail lock to a threaded portion of the retainer (block 800), and turning the retainer to cause the connecting portion of the bail lock to travel along the threaded portion of the retainer until the connector securely attaches to the device (block 810). For example, in implementations described above in connection with FIGS. 1 and 2, threaded portion 240 of retainer 170 may include a substantially cylindrical-shaped body that includes one or more threads (e.g., right-handed threads or left-handed threads) capable of receiving and attaching to connecting portion 230 of bail lock 160. In one example, if the threads of threaded portion 240 are right-handed threads, turning retainer 170 clockwise may cause connecting portion 230 of bail lock 160 to move toward head portion 250 of retainer 170 and may cause retainer 170 to move toward connector 120. This may increase a force applied by retainer 170 on connector 120, and may securely attach connector 120 to device 110.

CONCLUSION

Systems and methods described herein may provide a connector retainer for ensuring attachment of a connector to a device. For example, in one implementation, the device may include a connector receiver configured to receive the connector, and the connector may be connected to the device via the connector receiver. The connector retainer may include a bail lock and a retainer. The bail lock may be connected to the device adjacent to the connector receiver. The retainer may be attached to the connector, and the bail lock may be connected to the retainer to securely attach the connector to the device. The connector retainer configuration described herein may prevent the connector from disconnecting from the device, and may be simple, easy to use, and inexpensive.

The foregoing description provides illustration and description, but is not intended to be exhaustive or to limit the embodiments to the precise form disclosed. Modifications and variations are possible in light of the above teachings or may be acquired from practice of the invention.

For example, while a series of blocks has been described with regard to the flowcharts of FIGS. 5-8, the order of the blocks may differ in other implementations. Further, non-dependent blocks may be performed in parallel.

Even though particular combinations of features are recited in the claims and/or disclosed in the specification, these combinations are not intended to limit the invention. In fact, many of these features may be combined in ways not specifically recited in the claims and/or disclosed in the specification.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A system for retaining a connector connected to a device, comprising:

a bail lock that includes:

a foot portion to connect to the device, an elongate portion that includes a first distal end connected to the foot portion, and a connecting portion connected to a second distal end of the elongate portion; and a retainer that includes:

a threaded portion to engage the connecting portion of the bail lock, and a head portion connected to the threaded portion, where rotation of the head portion causes axial movement of the threaded portion such that the connecting portion of the bail lock moves along the threaded portion of the retainer to apply a varying retaining force between the retainer, the bail lock and the connector, and the varying retaining force depends on the axial movement.

2. The system of claim 1, where the foot portion, the elongate portion, and the connecting portion of the bail lock are integrally formed together.

3. The system of claim 1, where the bail lock comprises one or more of:

a thermoplastic polymer;

stainless steel;

a metal; or a metal alloy.

4. The system of claim 1, where the threaded portion and the head portion of the retainer are integrally formed together.

5. The system of claim 1, where the retainer comprises one or more of:

a thermoplastic polymer;

a metal; or a metal alloy.

6. The system of claim 1, where the retainer comprises a polycarbonate resin.

7. The system of claim 1, where the head portion of the retainer includes one or more recesses provided on a peripheral surface thereof, and where the recesses enable the head portion to be manipulated with one or more digits of a hand.

8. The system of claim 1, where a cavity is provided through a side surface of the threaded portion and a side surface of the head portion of the retainer to extend from a top surface to a bottom surface of the retainer.

9. The system of claim 8, where the cavity includes a width in a range of about four millimeters to about ten millimeters.

10. The system of claim 8, where the cavity includes:

two side portions; and a semicircular bottom portion interconnecting the two side portions.

11. The system of claim 8, where the cavity is sized to receive a cord attached to the connector.

12. The system of claim 1, where the bail lock further includes:

another foot portion to connect to the device; and another elongate portion that includes a first distal end connected to the other foot portion, where the connecting portion connects to and between the second distal end of the elongate portion and a second distal end of the other elongate portion, where the elongate portion extends in a first longitudinal direction between the first and second distal ends.

13. The system of claim 12, where the connecting portion of the bail lock includes:

a first arm portion connected to the second distal end of the elongate portion;

a second arm portion connected to the second distal end of the other elongate portion; and a U-shaped loop portion connected to and between the first arm portion and the second arm portion.

14. The system of claim 13, where the U-shaped loop portion is semi-circular shaped, where a dimension of an opening of the U-shaped loop portion is less than a diameter of the threaded portion, where the diameter of the threaded portion is smaller than the U-shaped loop portion, and where the threaded portion engages the U-shaped loop portion.

15. The system of claim 13, where the first arm portion is offset in the first longitudinal direction from the second arm portion to align the U-shaped loop portion with the threaded portion of the retainer.

16. The system of claim 15, where the offset includes a length in a range of about two millimeters to about 2.5 millimeters.

17. The system of claim 13, where the elongate portion and the other elongate portion are aligned at an angle to a line substantially perpendicular to a plane of the second arm portion.

18. The system of claim 17, where the angle is in a range of about five degrees to about ten degrees.

19. The system of claim 1, where the threaded portion of the retainer includes a plurality of threads provided a distance from each other by a plurality of corresponding spaces.

20. The system of claim 9, where the plurality of corresponding spaces are capable of engaging the connecting portion of the bail lock.

21. A method for retaining a connector connected to a device, comprising:

attaching the connector to the device;

attaching a bail lock to the device adjacent to the connector;

receiving a cord of the connector with a retainer; and connecting the bail lock to the retainer to securely attach the connector to the device, where connecting the bail lock to the retainer includes:

engaging a connecting portion of the bail lock at an engagement surface of the retainer, applying a retaining force from the connecting portion through the engagement surface to the connector, attaching the connecting portion of the bail lock to a threaded first portion of the retainer; and rotating the retainer to move the connecting portion of the bail lock along the threaded first portion of the retainer to apply a varying retaining force between the retainer, the bail lock and the connector, the varying retaining force depending on the rotation of the retainer, and where attaching the bail lock to the device comprises:

attaching one or more foot portions of the bail lock to bail lock receivers provided on the device, and providing a horseshoe-shaped connecting portion of the bail lock adjacent to the cord of the connector.

22. The method of claim 21, where attaching the connector to the device comprises:

attaching the connector to a connector port provided in the device.

23. The method of claim 21, where the retainer is configured to have a top, a bottom and at least one side surface therebetween, where receiving a cord of the connector comprises:

providing the cord of the connector within a cavity provided in the at least one side surface of the retainer; and providing the retainer adjacent to a connecting portion of the bail lock.

24. The method of claim 21, where attaching the bail lock to the device comprises:

attaching one or more foot portions of the bail lock to bail lock receivers provided on the device, and providing a horseshoe-shaped connecting portion of the bail lock adjacent to the cord of the connector.

* * * * *